US007402106B2

(12) United States Patent
Weisel, Jr. et al.

(10) Patent No.: US 7,402,106 B2
(45) Date of Patent: Jul. 22, 2008

(54) COMPUTER CONTROLLED CAR RACING GAME

(75) Inventors: Charles W. Weisel, Jr., Greenville, SC (US); David A. Myus, Greer, SC (US); Randolph A. Lasee, Pulaski, WI (US); James H. Pagel, Sr., Oconto, WI (US)

(73) Assignee: Bay Tek Games, Inc., Pulaski, WI (US)

( * ) Notice: Subject to any disclaimer, the term of this patent is extended or adjusted under 35 U.S.C. 154(b) by 385 days.

(21) Appl. No.: 11/088,139

(22) Filed: Mar. 23, 2005

(65) Prior Publication Data

US 2005/0215327 A1 Sep. 29, 2005

Related U.S. Application Data

(60) Provisional application No. 60/556,009, filed on Mar. 24, 2004.

(51) Int. Cl.
*A63H 7/04* (2006.01)
*G08C 17/00* (2006.01)

(52) U.S. Cl. ..... 463/63; 463/58; 273/445

(58) Field of Classification Search ..... 463/5–7, 463/23, 30–32, 34, 36–37, 42–43, 58–69; 273/108.1, 108.3, 108.4, 317.1, 359, 366–368, 273/150, 329–330, 406–407, 440.1, 441–442, 273/460–461

See application file for complete search history.

(56) References Cited

U.S. PATENT DOCUMENTS 3,630,524 A * 12/1971 Cooper et al. ..... 463/63
4,148,485 A * 4/1979 Rains ..... 463/6
4,201,012 A * 5/1980 Marshall ..... 446/175
4,232,865 A * 11/1980 Chen et al. ..... 463/50
4,334,221 A * 6/1982 Rosenhagen et al. ..... 463/6
4,662,854 A * 5/1987 Fang ..... 446/175
4,817,948 A * 4/1989 Simonelli ..... 463/6
4,844,493 A * 7/1989 Kramer ..... 180/169
4,865,575 A * 9/1989 Rosenthal ..... 446/175

(Continued)

FOREIGN PATENT DOCUMENTS

JP 2082992 * 3/1990

(Continued)

*Primary Examiner*—Robert E. Pezzuto
*Assistant Examiner*—Arthur O. Hall
(74) *Attorney, Agent, or Firm*—Andrus, Sceales, Starke & Sawall, LLP

(57) ABSTRACT

A computer controlled toy car racing game that can be played by a plurality of players. If less than a maximum number of players is present at the beginning of a race, a computer controller operates the remaining race cars such that each race includes all of the race cars. The racing game includes numerous sensors positioned above the racing course that relay control commands to each of the race cars. If a race car is computer controlled or computer assisted, the control commands are created by the computer controller. If the race car is controlled by a player, the control commands include information from a throttle and steering wheel used by the player. Upon completion of a race, the computer controller controls each of the race cars to bring the race cars back to a point on the race course near the start/finish line.

20 Claims, 9 Drawing Sheets

U.S. PATENT DOCUMENTS 5,127,658 A * 7/1992 Openiano ..... 463/50
5,203,733 A * 4/1993 Patch et al. ..... 446/444
5,368,484 A * 11/1994 Copperman et al. ..... 434/69
5,577,913 A * 11/1996 Moncrief et al. ..... 434/69
5,723,855 A * 3/1998 Oh et al. ..... 250/206.1
5,749,547 A * 5/1998 Young et al. ..... 246/4
5,800,263 A * 9/1998 Hayashida et al. ..... 463/6
5,924,927 A * 7/1999 Matsuura et al. ..... 463/62
6,059,657 A * 5/2000 Oh et al. ..... 463/6
6,109,186 A * 8/2000 Smith et al. ..... 104/295
6,461,238 B1 * 10/2002 Rehkemper et al. ..... 463/6
6,471,586 B1 * 10/2002 Aiki et al. ..... 463/6
6,780,077 B2 * 8/2004 Baumgartner et al. ..... 446/175
7,004,838 B2 * 2/2006 Hayashida et al. ..... 463/31
7,098,891 B1 * 8/2006 Pryor ..... 345/158
7,107,196 B2 * 9/2006 Waterston ..... 703/8
7,147,535 B2 * 12/2006 Simeray ..... 446/175
7,217,192 B2 * 5/2007 Nishiyama ..... 463/43
2002/0102910 A1 * 8/2002 Donahue et al. ..... 446/465
2002/0185041 A1 * 12/2002 Herbst ..... 108/25

FOREIGN PATENT DOCUMENTS

JP 2002228777 A * 8/2002

* cited by examiner

COMPUTER CONTROLLED CAR RACING GAME

CROSS REFERENCE TO RELATED APPLICATION

The present application is based on and claimed priority to U.S. Provisional Patent Application Ser. No. 60/556,009 filed on Mar. 24, 2004.

BACKGROUND OF THE INVENTION

The present invention is related to an amusement game in which several players operate remote-controlled vehicles. The game may be coin-operated, or otherwise unattended. One of the goals of the racing game of the present invention is for the game to operate without the need for an attendant, thus avoiding the cost of the attendant's labor.

The problems with previously existing remote-controlled car racing games are as follows:

(1) The vehicles that are not being driven by a player are stationary, in various places on the playing surface. These vehicles are often in the way of the other vehicles that are being driven by the current players, causing difficulty for the players and frustration.

(2) At the end of a game, the vehicles stop in the positions where a player last drove them. In currently available games, there is no way for the cars to automatically line up in a logical starting position for a new race. This can result in some vehicles having a much better starting position than others, and some vehicles have a very poor starting position.

(3) Some beginning players and young children do not have the skill needed to effectively control a remote-controlled vehicle. For these players, the playing experience can be frustrating and unpleasant, rather than amusing and entertaining.

(4) Previous remote-control driving games do not provide a means for the receipt of any data from the vehicles.

(5) Previous remote-control driving games do not have a means for sensing the position of the vehicles on the playing surface as the vehicle travels around the race track, as well as the orientation of the vehicle on the race track.

(6) Previous remote-control driving games do not provide information about the location of each vehicle at all points on the playing surface in real-time. This limits the capability of automated race announcing systems to comparing the number of laps completed. (Changes in relative positions that occur part of the way around the track are not reported until the end of the current lap.)

(7) Previous remote-control driving games use radio frequency communication as the medium for the control signals, which is very susceptible to interference from electrical noise.

(8) Previous remote-control driving games require periodic adjustment of the vehicles' speed, to keep the speeds comparable to one another.

(9) Previous remote-control driving games require periodic manual adjustment of the vehicles' steering center adjustment, to keep the vehicles from veering to one side.

SUMMARY OF THE INVENTION

The present invention is a computer controlled car racing game that provides a solution to the problems inherent in previous remote-controlled vehicle driving games. The computer controlled car racing game of the present invention provides at least the following features:

(1) The vehicles that are not being driven by a player are controlled by a computer control system, which simulates the action of other players, or adds interest to the game as opposed to the non-player controlled cars being stationary.

(2) The vehicles can be moved by the computer control system to good starting positions for the next race, or the vehicles can be moved off of the playing surface, if desired.

(3) The computer control system provides varying levels of help to players, to help them to control the vehicles. This feature enables the game to provide amusement to players with varying skill levels. It also allows players with various skill levels to play the game together with a more pleasant experience.

(4) The racing game provides a means of receiving data from the remote-controlled vehicles, with two-way communication between the vehicles and the computer control system.

(5) The racing game provides a means for sensing the position and direction of travel of the vehicles on the playing surface.

(6) The racing game provides a means for controlling and/or modifying the vehicles' operation via software, with feedback from the vehicle and position and direction information.

(7) The racing game provides a means for monitoring many aspects of the vehicles' operation via software with information sent from the vehicle to the computer control system.

(8) The racing game provides a means for providing virtual reality and other sensory feedback to the players using information sent from the vehicle to the computer control system.

(9) The racing game provides a means for detecting the relative positions of each vehicle at all points on the track, allowing the race announcing software to be more responsive to rapid changes in the race as cars pass one another.

(10) The racing game uses infrared light as the communication medium, which is very insensitive to interference from electrical noise.

(11) The racing game uses a sensor to measure the drive motor RPM in each vehicle, with a feedback system to ensure the correct motor speed, eliminating the need for speed adjustments.

(12) The racing game uses software control to compensate for errors in the steering center adjustment, minimizing the need for manual adjustments.

(13) The racing game provides a means of operating the vehicles automatically when the game is not being played, for example, to demonstrate the play action and attract the attention and interest of prospective players.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF PREFERRED EMBODIMENTS

Figure 1:
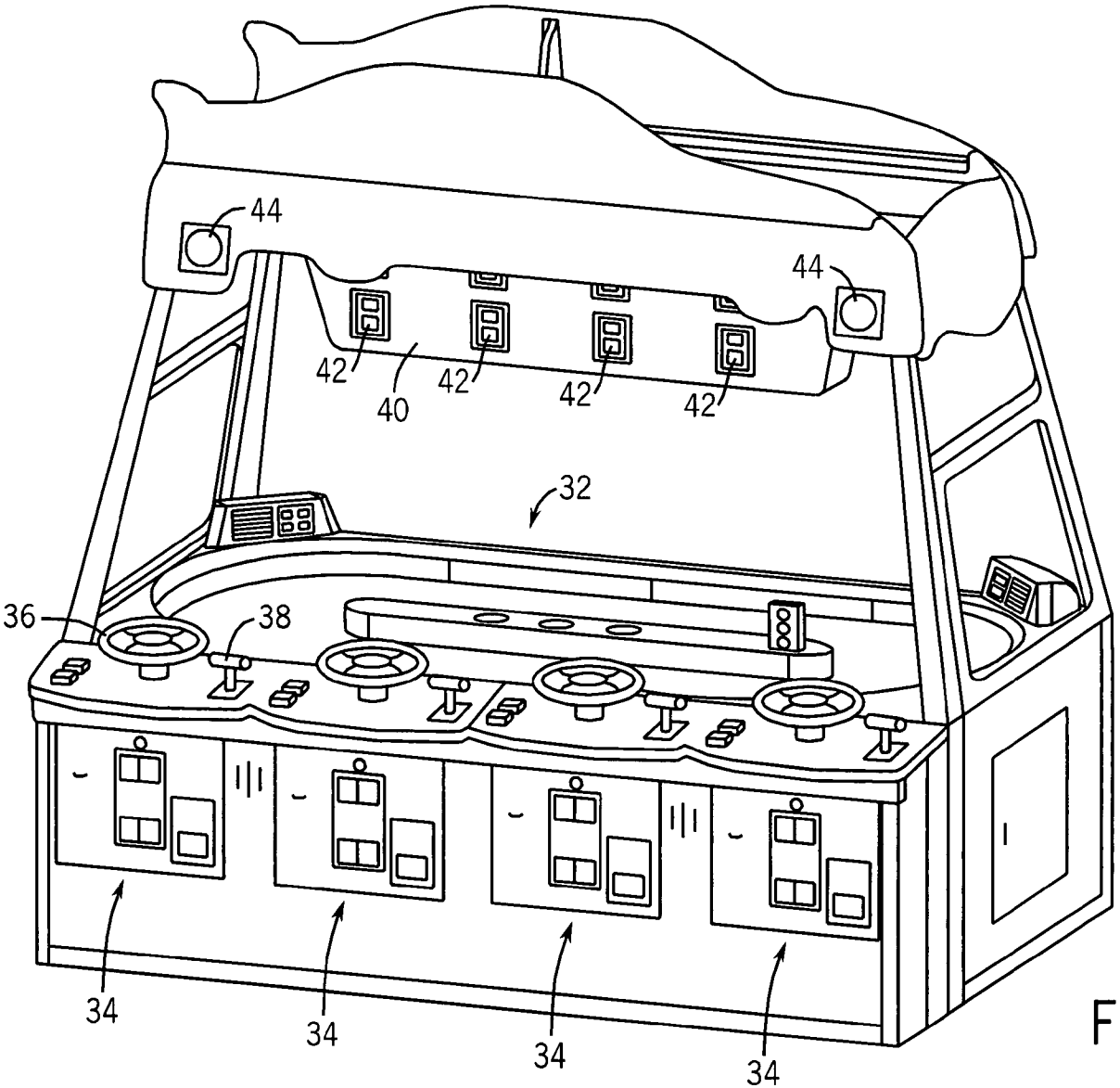
FIG. 1 is a diagram of an amusement game which involves several players driving remote-controlled vehicles on a driving surface.

Referring first to FIG. 1, there is shown a coin-operated, stock car racing game 30. In this game, up to four players race $1/24^{th}$ scale remote controlled cars on an electric race track 32. Other types of vehicles can be operated in the same manner, and many other game formats are possible besides racing games. The track is made in an oval shape, consisting of two straight sections joined together by two half-round curved sections. Many other track configurations are possible; this shape was chosen to conserve floor space. The use of an electric track is also optional, since the cars could optionally be powered with batteries or other methods. The electric track 32 allows the cars to have full proportional steering (without slots or other limitations), as well as proportional throttle control. In accordance with the preferred embodiment of the invention, the racing game 30 includes four control stations 34, each of which includes a steering wheel 36 and a throttle 38 to provide the input to a computer control system (CCS), to operate the race cars.

The object of the game is to drive the cars around the oval track as many times as possible during the playing time allowed. Each time a car completes a lap, the player is credited with one lap. The lap counts of the four cars are shown on the computer scoreboard 40, and the cars are ranked in their respective standings in first, second, third and fourth positions on the light displays 42. A computer-generated announcer's voice announces the progress of the race through speakers 44 and the numbers of the cars in each position. At the end of the time allowed for a game, the car with the most laps is declared the winner.

In an earlier model of the game, after the completion of a race, all cars stop in their current positions on the track, where they remain until the start of the next game. When a player inserts enough money to play the game, a countdown begins, allowing time for other players to insert coins to compete in the same race. After the countdown, the race begins. During the race, the cars that are not being controlled by a player remain on the track without moving. The main disadvantage in this prior art game is that these unused cars are in the way of the paying players, who are trying to complete laps as fast as possible. One other disadvantage of the older, prior art game is that it is too difficult for small children and some beginning players, who do not have the skill needed to compete with experienced players in a fast-paced, remote-controlled car race.

In the game of the present invention, at the end of each race when the playing time is up, all of the cars are driven by the CCS to the Start/Finish Line, where they generally line up in position for the next race. Then, during the next race, the cars that are not being driven by a paying player are driven by the CCS as "drones". The ability of the CCS to operate the cars not assigned to a paying player makes the game more interesting and challenging for the players, and prevents the cars from being in the way as stationary "obstacles" on the track. The computer driven drones typically drive laps around the oval track. If the computer controlled cars encounter an obstacle, or are hit by another car and are knocked out of position, the CCS automatically re-orients the drone cars and the cars resume making laps along with the paying players.

For small children and other players who have not acquired the skill needed for competitive racing, the CCS provides an option of computer-assisted driving. In the preferred embodiment of the present invention, two different skill levels are supported, although more or fewer levels are contemplated.

In the Beginner level, the paying player has control of the car's forward and reverse speed, but the CCS controls the car's steering system. Players can move the steering wheel 36 to the left and right, but the steering input is modified by the CCS to help the player. The CCS thus enables the players to drive laps around the track simply by operating the throttle 38. In the preferred embodiment of the invention, in the straightaways the player is allowed some limited side-to-side movement, to move toward the inside or outside guardrails, but not enough movement to run into the guard rails. If the car is knocked completely out of line by another car, the CCS gives the player control of the steering function long enough to get the car re-oriented.

In the Expert skill level, players have full control of the steering at all times with no computer-assisted driving. In the Expert level, the maximum forward speed is also set to be the highest since it is assumed that expert players can either handle the car at full speed or are skilled enough to adjust their speed as necessary without help from the computer.

The CCS of the racing game allows several players to compete at different skill levels in the same race. The computer-assisted driving helps the less-skilled players without giving them an undue or unfair advantage over players who drive as expert drivers. This ensures a fun experience for players of all ages and skill levels.

Figure 3:
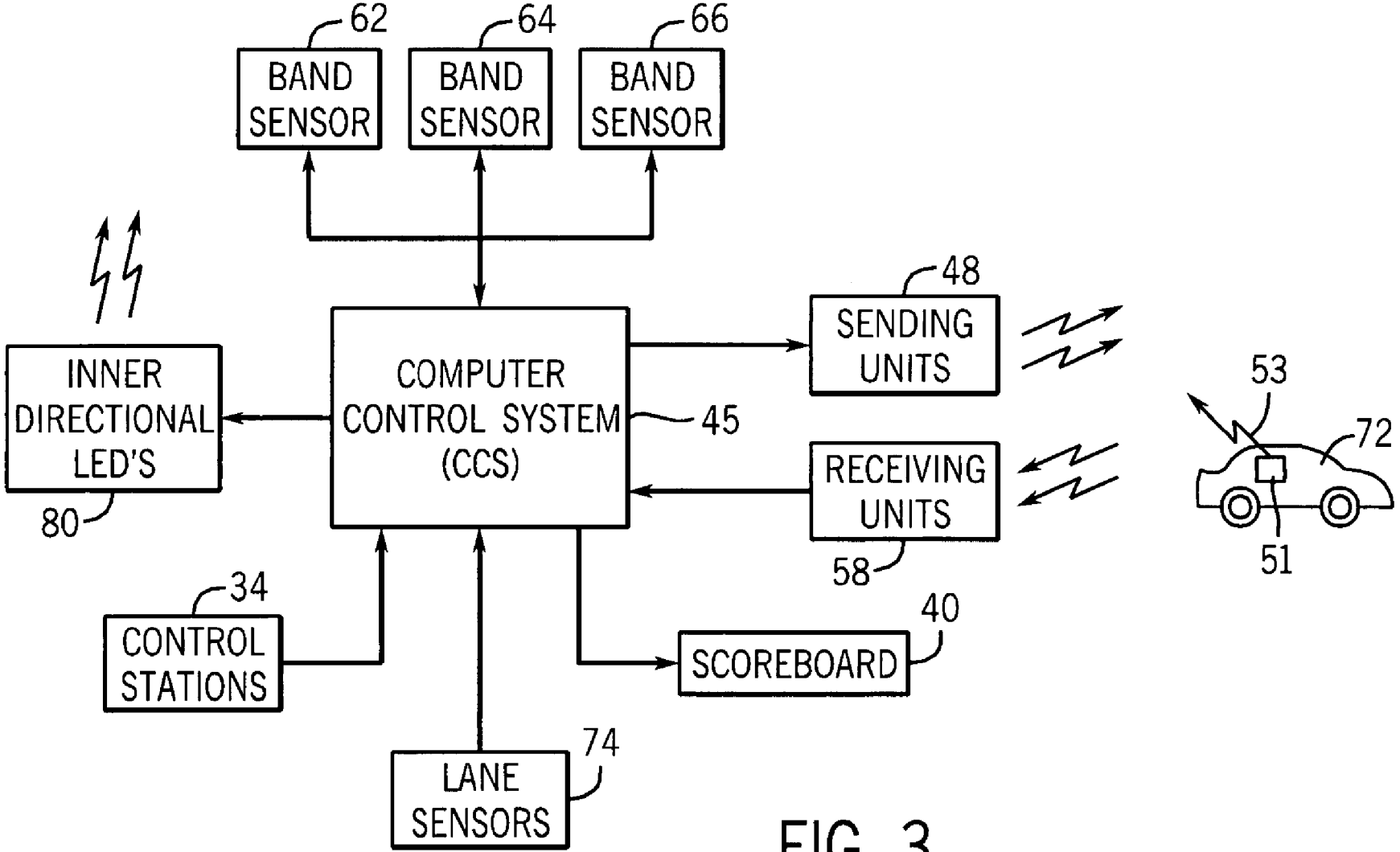
FIG. 3 is a schematic control diagram for the computer controller.

The player controls consist of steering wheel 36 and throttle mechanisms 38, which provide inputs from the control station 34 to the computer control system 45 (CCS), as shown in FIG. 3. In the preferred embodiment of the invention, the control signals are sent to and from the cars by digitally encoded command signals modulated on an infrared light (IR) beam sent by the control signal sending units 48. Each of the race cars 72 is assigned a unique address such that each race car responds only to the digitally coded command signal meant for the race car. Specifically, each command signal includes the car address, steering position and throttle position for the car. In the embodiment of the invention illustrated, each of the cars receives the command signal approximately twenty times a second. Other transmission mediums could be used for this purpose, such as radio frequency signals, but IR light is relatively inexpensive and has many benefits, including insensitivity to electrical noise. In addition to utilizing IR signals for controlling the cars, the IR signals have other uses, such as for determining the position and orientation of cars on the track as will be discussed in detail below.

Figure 2:
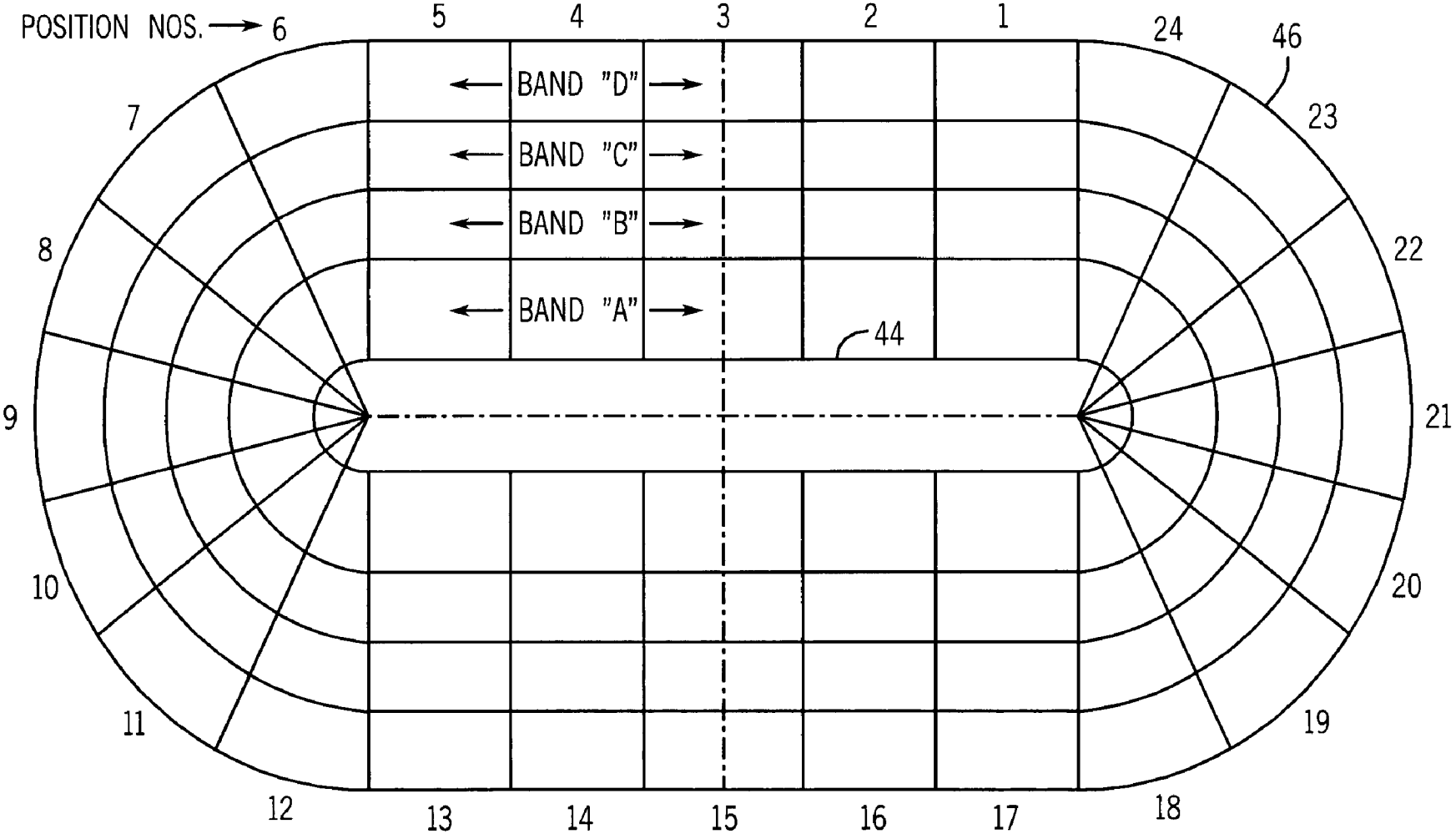
FIG. 2 illustrates the layout of the race course and the position numbers and band identifiers for four concentric oval-shaped bands that divide the race course into smaller segments.

In the preferred embodiment of the invention, the race track surface, shown in FIG. 2, is divided into twenty-four positions around the perimeter of the track, labeled as positions 1-24, and four radial bands, labeled as bands A, B, C and D. This subdivision of the track surface allows the computer software the ability to identify the location of each car along the length of the race track (positions 1-24) as well as the position of the car relative to the inner guard rail 44 and outer guard rail 46 on the track (bands A-D), and make logical decisions about how to move the cars, when under computer control.

Figure 4:
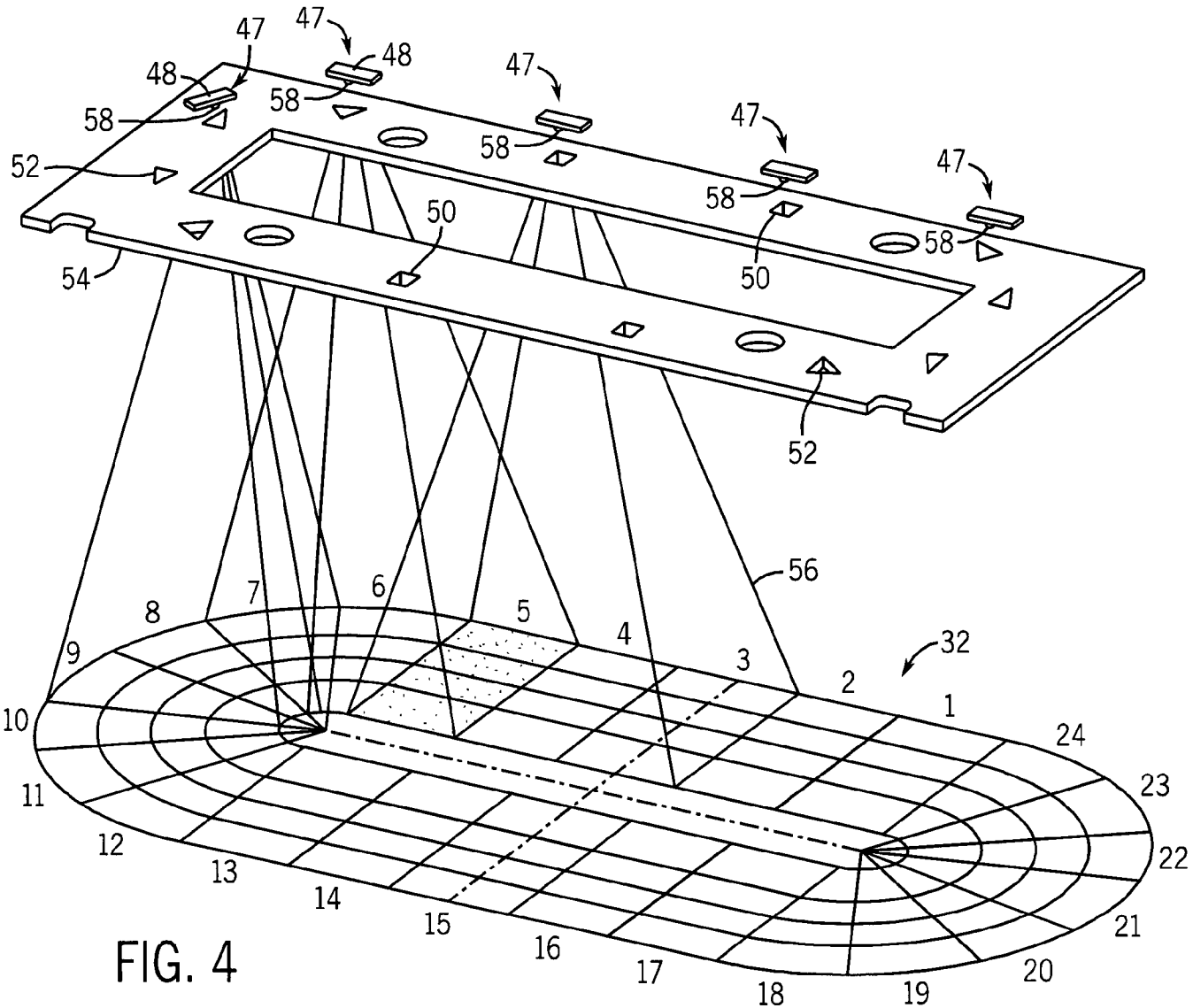
FIG. 4 illustrates the IR sending and receiving units positioned above the track to identify each cars' position on the race track.

Referring now to FIG. 4, thereshown are a plurality of circuit boards 47 that each include a control signal sending unit 48. Each circuit board 47 is aligned with either a first template opening 50 or a second template opening 52 formed in the position template 54. The position template 54 is formed from a material that selectively blocks the transmission of IR light beams. The position template 54 is preferably mounted above the race track 32 and around the center scoreboard 40, as illustrated in FIG. 1.

Referring back to FIG. 4, only five of the circuit boards 47 including the control signal sending units 48 are illustrated for the sake of clarity. However, it should be understood that in the embodiment illustrated, twelve circuit boards 47 are utilized, one of which is aligned with each of the template openings 50, 52.

As illustrated in FIG. 4, each of the control signal sending units 48 is positioned above the race track 32 and configured such that the IR light beams generated by each of the sending units 48 is directed downward toward the race track through the template 54. The transmitted IR light beam passes through the windshield of the vehicle as the vehicles travel around the race track 32 and are received by sensors within the vehicles, as will be described in greater detail below. The internal control units of each vehicle decode the control command signals generated by each of the sending units 48 such that the vehicle responds to the command signals.

As illustrated in FIG. 4, each of the sending units 48 generates an area of light on the race track 32, as generally illustrated by the lines 56. Preferably, the sending units 48 are spaced around the race track at intervals such that the IR light pattern from the adjacent sending units 48 overlap with each other. As illustrated in FIG. 4, every area on the race track 32 is illuminated by one or more of the sending units 48 such that each race car can receive the control command signal no matter the position of the race car on the race track 32.

Each of the sending units 48 are operated by the computer control system to simultaneously send the control command signals to a single car at any time. Each car has an ID number from one to four. The computer controller generates control data for each car that is preceded in the control command signal by the car's ID number, to allow each car to identify its data. The control data includes the speed and direction of the drive motor, and the left and right direction for the steering. The data rate is fast enough (20 times/sec) to allow each car to receive control data fast enough to have no perceptible time lapse in control responses, as seen by the players. The control data sent to the cars may include other digitally encoded data that can be used for various purposes.

Each time a car recognizes its ID, and receives its control data, it also sends a response message back to the CCS, by a similar response signal generating device 51 contained in the car, as shown in FIG. 3. Each of the car-mounted signal generating devices 51 generates an IR beam 53 that is aimed upwards toward the ceiling of the game.

As illustrated in FIG. 4, the circuit boards 47 in the ceiling of the game each contain an IR signal receiving unit 58 that receives the IR beams transmitted by each of the cars as the cars travel around the track. Although only five circuit boards 47 are shown in FIG. 4, it should be understood that a circuit board 47 and receiving unit 58 is aligned with each of the template openings 50,52 such that the embodiment illustrated includes twelve receiving units 48. Each of the signal receiving units 58 is positioned above one of the template openings 50,52 and directly adjacent one of the control signal sending units 48. The data received from the cars are then sent back to the CCS for further processing, as shown in FIG. 3.

The data sent by the cars may include digitally encoded information about the car, which may be used for various purposes. This feature supports many future enhancements and allows other game formats besides the current racing game. In the current racing game, the other digital information sent by each car to the CCS is related to the cars' direction sensor input, which is described in detail below.

As illustrated in FIG. 4, the receiving units 58 are spaced around the race track such that the car response data is detected by one or more of the IR receiving units 58. The receiving units 58 are connected to the CCS 45 to relay the car information to the CCS, as shown in FIG. 3.

Based on which of the receiving units 58 is receiving information from a car, the CCS 45 can determine the car's position on the track from the receiving unit pattern. As the car moves around the track, different receiving units 58 will receive the car information. The area of the track that is associated with each receiving unit 58 is controlled by the shape of the template openings 50, 52 in the position template 54, in the upper ceiling of the game, which admit the IR light beams, as shown in FIG. 4. The shape of the template openings 50,52 allows the receiving units 58 to accurately identify the position (1-24) of the cars on the race track 32. There are twelve sending and receiving units 48,58 for position data, but the track is divided into twenty-four positions. In the odd-numbered track positions, cars will activate two receiving units 58 at the same time. The CCS uses that fact to effectively double the precision of the position sensors, so that twenty-four positions can be identified with only twelve sensors. In FIG. 4, position five on the track is the point at which two sensors both detect the same car. This position data provides information to the CCS that is used for controlling the cars as drones and providing computer assistance to the players.

Previous remote-controlled driving games only sense the position of the car at a single point, typically at the location where laps are counted. The single position sensing of prior games limits the capability of automated race announcing systems in comparing the number of laps completed. Changes in relative positions that occur part of the way around the track are not reported until the end of the current lap. The present invention allows the race announcing software to be more responsive to rapid changes in the race as cars pass one another at any point on the track.

Figure 5:
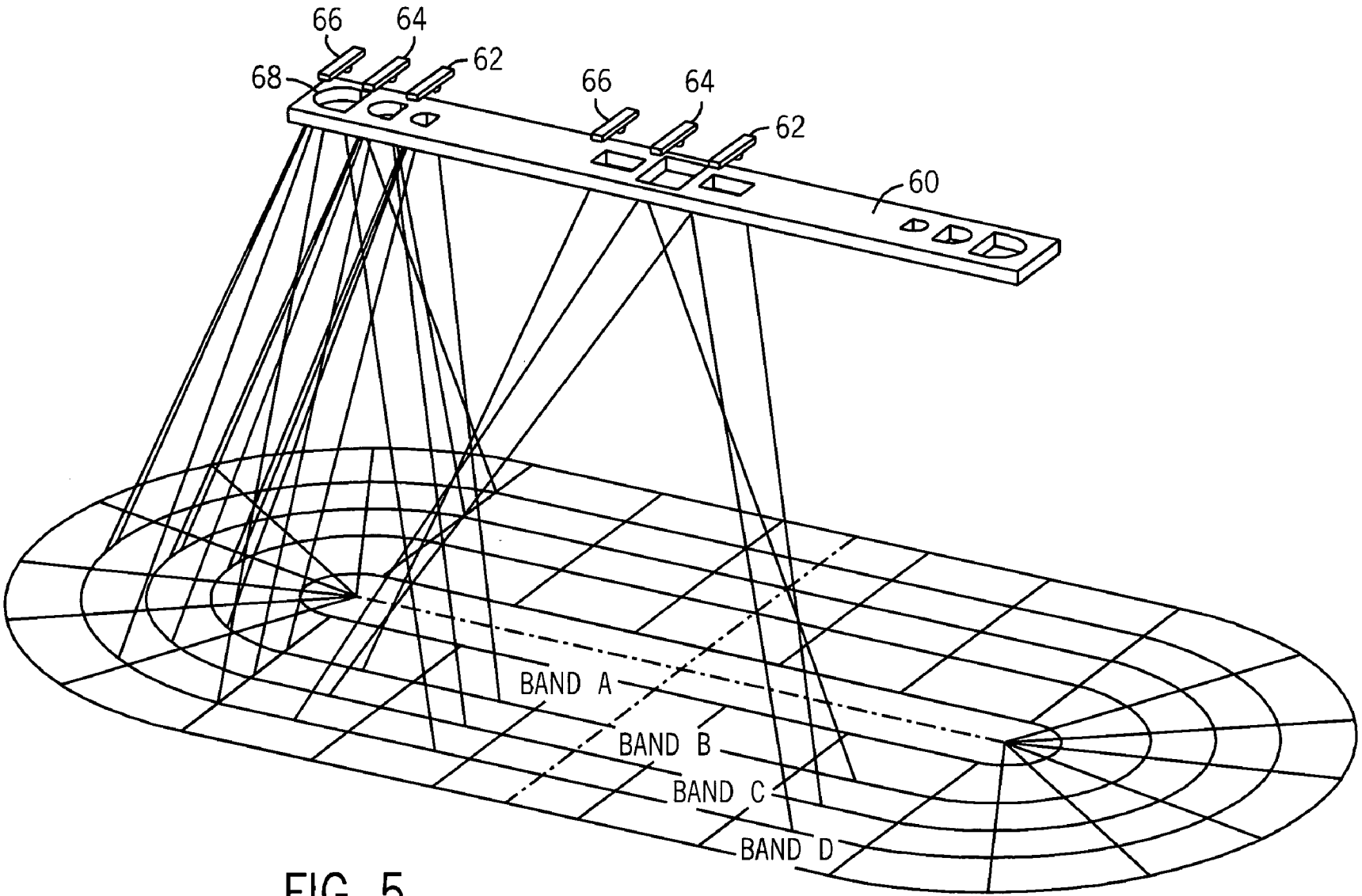
FIG. 5 shows the IR band sensors positioned above the track that are used to identify the band that each car occupies on the race track.

A second group of IR sending and receiving units are used with the band template 60, as shown in FIG. 5, to identify the band of the track where cars are located. These sending and receiving units operate on the same principle as the position sensing, described above, and are coupled to the computer control system 45 as shown I FIG. 3. The receiving units are positioned in such a way as to detect cars within one of more of the concentric, oval-shaped "bands" on the track. The band A sensor 62 only detects cars that are in band A, hence cars that it detects are interpreted by software as being in band A. The band B sensor 64 detects cars that are in both bands A and B; hence the CCS software interprets cars that are detected by the band B sensor 64 and the band C sensor 66 but not the band A sensors 62 as being in band B. In the same manner, the band C sensor detects cars within bands A, B and C. Since bands A and B are included within the area designated as band C, software interprets the cars that are only detected by band C sensor 66 and not bands A and B as being in band C. If no band sensors detect a car, it is assumed by software to be in Band D by default, since it must always be in one of the bands.

As illustrated in FIG. 5, the band template 60 includes a template opening 68 positioned beneath each of the band sensors 62, 64 and 66. The size and shape of the template opening 68 defines the sensing area for each of the band sensors 62-66. In the preferred embodiment of the invention, the band template 60 is positioned beneath the score board 40, as best illustrated in FIG. 1.

Figure 6:
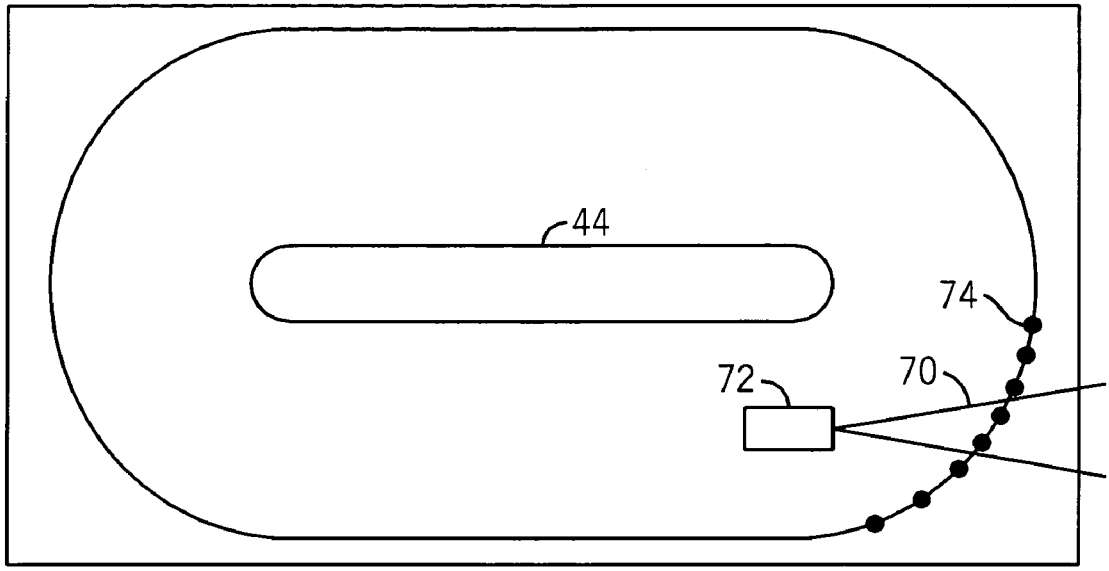
FIG. 6 shows how each car emits an IR directional beam that activates the lane sensors.
Figure 7:
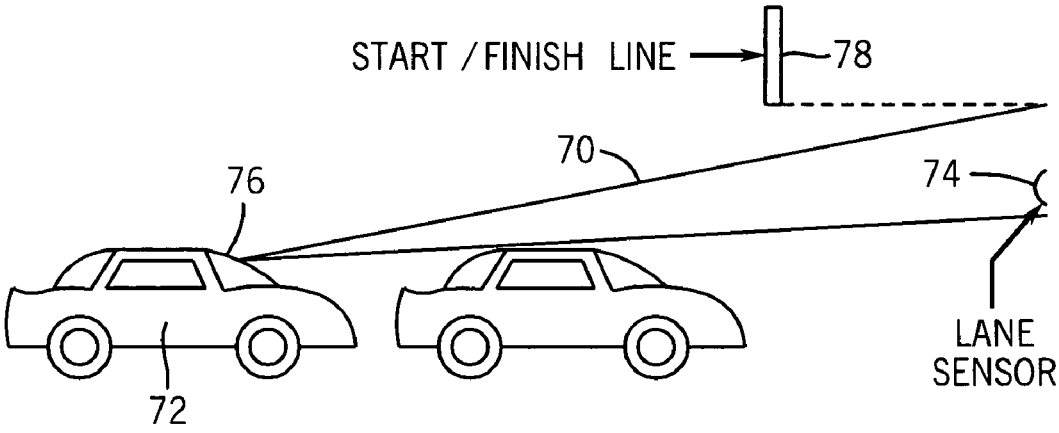
FIG. 7 shows how each car's directional beam is aimed over the top of the other cars, so other cars will not block the beam.

Each time a car recognizes its ID, the race car 72 sends an infrared car directional beam 70 out the front windshield of the car generally in the direction of car travel, as shown in FIGS. 6 and 7. In the preferred embodiment of the invention, the car directional beam 70 is a specially modulated IR beam that is collimated by a slit aperture to form a vertical-shaped pattern of light projecting from the front of the car. The beam is sent for a brief period of time, before the CCS begins sending the command signal for the next race car.

As shown in FIG. 6, a plurality of individual lane sensors 74 are embedded in the outer guardrail around a portion of the curved sections of the race track. Each of the lane sensors 74 of the racetrack detects the car direction beam 70 from the individual car as the car travels on the adjacent straight section of the track. As shown in FIG. 3, each of the lane sensors 74 is connected to the CCS 45 to enable the CCS 45 to determine which lane sensors 74 detect the car's directional beam. Based upon which of the lane sensors 74 is detecting the car's directional beam, the CCS can quickly and accurately determine the direction of car movement in the straightaways.

As described above, each of the race cars 72 generates the car directional beam 70 only after receiving the control command from the CCS. When the race car associated with the most recently transmitted control command generates the car directional beam 70, the CCS knows that the lane sensors 74 that detect the directional beam 70 are detecting the directional beam 70 from the most recently addressed race car. The race car 72 is configured to generate the car directional beam 70 for a brief period of time that ends prior to the CCS generating the control command for the next race car. Thus, at any given time during the race, only one of the race cars 72 is ever generating the car directional beam. In this manner, the CCS can interpret the signals received from the lane sensors 74 to determine the position of each individual race car on the race track.

The CCS can use the position data from the signal receiving units 58 and the data from the lane sensors 74 to steer the cars as drones toward the lane sensors 74 in the straightaways and provide computer assistance to the players.

FIG. 7 shows how the car directional beam 70 of each car 72 is directed out the front windshield 76 of the car. In accordance with the invention, the car directional beam 70 is positioned such that the beam 70 is projected over the top of the other cars at an angle that ensures that the beam is not blocked by the other cars. The car directional beam 70 must also pass under the optional Start/Finish Line sign 78, so it is not blocked by the Start/Finish Line sign. The vertical shape of the car directional beam 70 enables it to activate the lane sensor 74 at any distance from the sensor 74, since the beam 70 must be projected at an angle above the nearby cars. The width of the beam ensures that it does not become too wide when the car is the maximum distance from the lane sensors 74 (thereby activating too many sensors), or too narrow when the car is the minimum distance from the sensors 74 (operating too few sensors).

An optional feature of the present invention is a physical Start/Finish line 78 sign above the track. Some versions of the racing game do not have a physical sign, but simply use a designated place on the track for the purpose of a starting line and the position for counting laps. Each time a car passes under the optional Start/Finish line sign 78 , multiple IR sending and receiving units mounted under the Start/Finish line sign sense the car, and the CCS credits the car with a completed lap. The present invention (with, or without the Start/Finish line sign) has an advantage over previous remote-control racing systems because of its ability to sense the cars' location at all points on the track, and require the car to travel all the way around the track circuit in the correct direction, in order to score a lap. Previous remote-control systems typically can be fooled into giving credit for a lap if the vehicle passes back and forth under the lap counter sensor, instead of driving all the way around the track.

Figure 8:
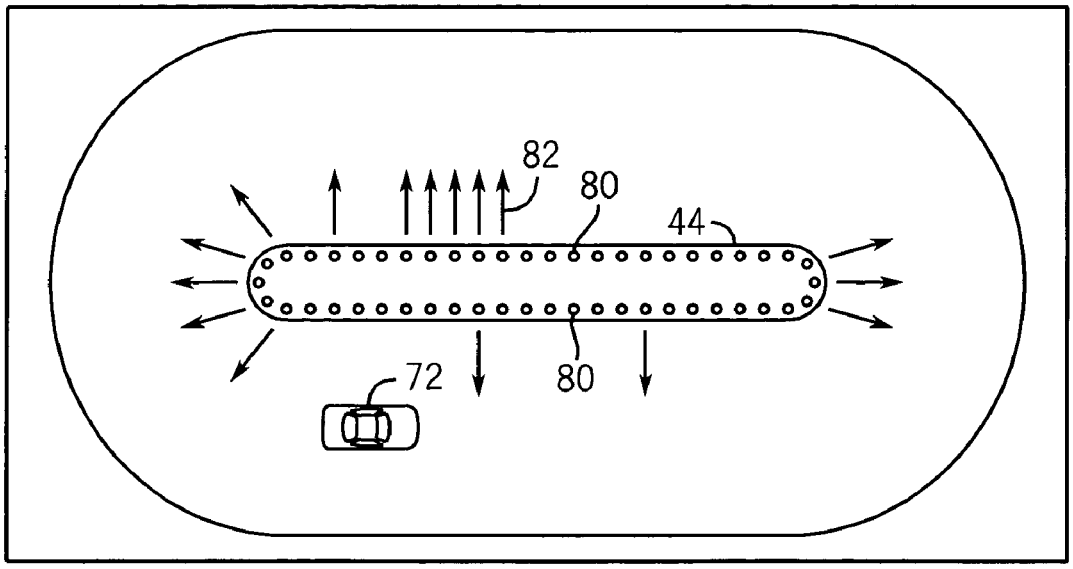
FIG. 8 shows a plurality of IR light-emitting diodes that are embedded in the inside guard rail of the track, directing a light beam outwards across the track surface.

FIG. 8 illustrates a plurality of inner directional IR Light-Emitting Diodes (LEDs) 80 that are embedded in the inside guard rail 44 of the racetrack. Each of these LEDs 80 are used to generate a reference beam of light 82 to operate sensors in each car, which determine the direction the cars are facing, with respect to the inside guard rail 44.

Figure 9:
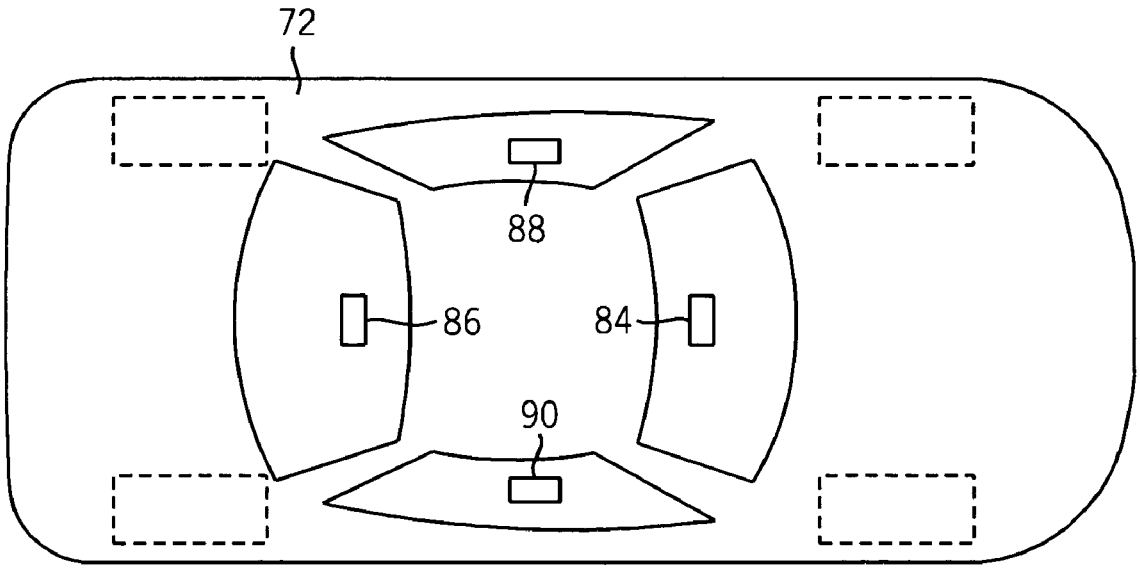
FIG. 9 shows the IR direction sensors in the car, which provide an indication of which side of the car is facing the inside guardrail.
Figure 10:
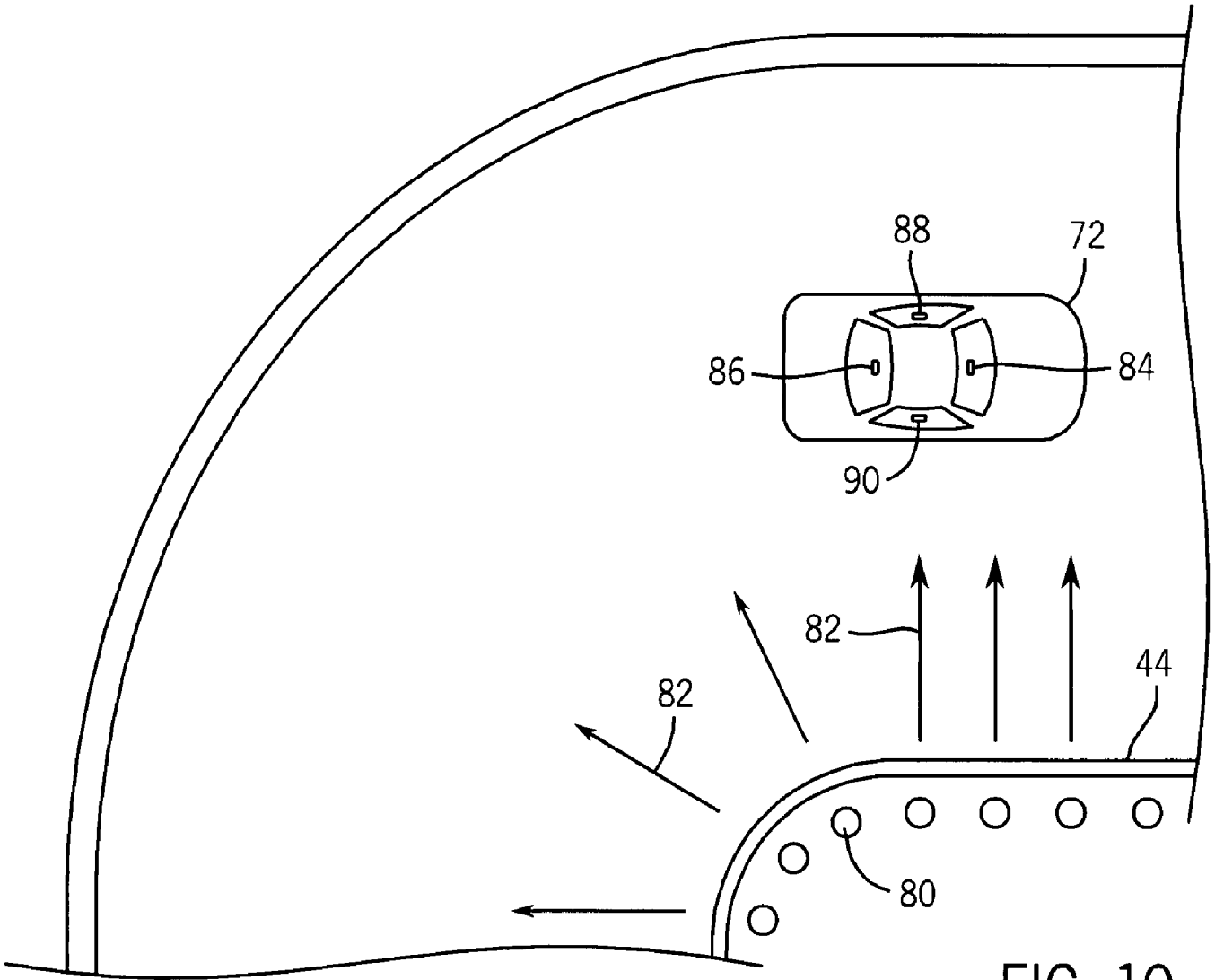
FIG. 10 shows the direction sensors in the car receiving the reference beam from the IR light-emitting diodes along the inner guard rail.

Referring now to FIG. 9, each individual race car 72 includes a front direction sensor 84, a rear direction sensor 86, a left direction sensor 88 and a right direction sensor 90 that are mounted within the car and are activated by the reference beams generated by the inner directional LEDs 80 positioned along the inside guard rail 44. As the cars move around on the track surface, the direction sensors 84-90 facing the reference beams generated by the LEDs 80 along the inside guard rail 44 are activated, as is illustrated in FIG. 10. When the race car 72 sends data back to the CCS via the infrared communication link, the race car internal processor relays information about which of the direction sensors 84-90 were activated during the last operational sequence. Information regarding which of the direction sensors 84-90 detected the reference signal enables the CCS to determine the direction each car is facing at all points on the track, even when the cars are not directed toward any of the lane sensors 74. This direction information is used by the CCS to make control decisions to steer the cars when they are not in the correct orientation to drive toward one of the lane sensors 74. This information can be particularly useful after a crash along the race track, or at the end of the race after players stop driving the cars and the CCS must drive each of the cars back to the starting line.

In accordance with the present invention, each car has a sensor that detects the speed of the motor (RPM). This motor speed information is used in a feedback system to ensure that the cars drive at the desired speed. If the measured motor RPM does not match the RPM requested by the CCS, the control system within the car will make the necessary adjustments. This allows the car control system to automatically match the speeds of the cars, overcoming the mechanical differences caused by wear and tear, differences in motor efficiencies, friction in the gear and drive system, and so forth. This feature eliminates the need for periodic manual adjustments to match the car speeds.

Figure 11:
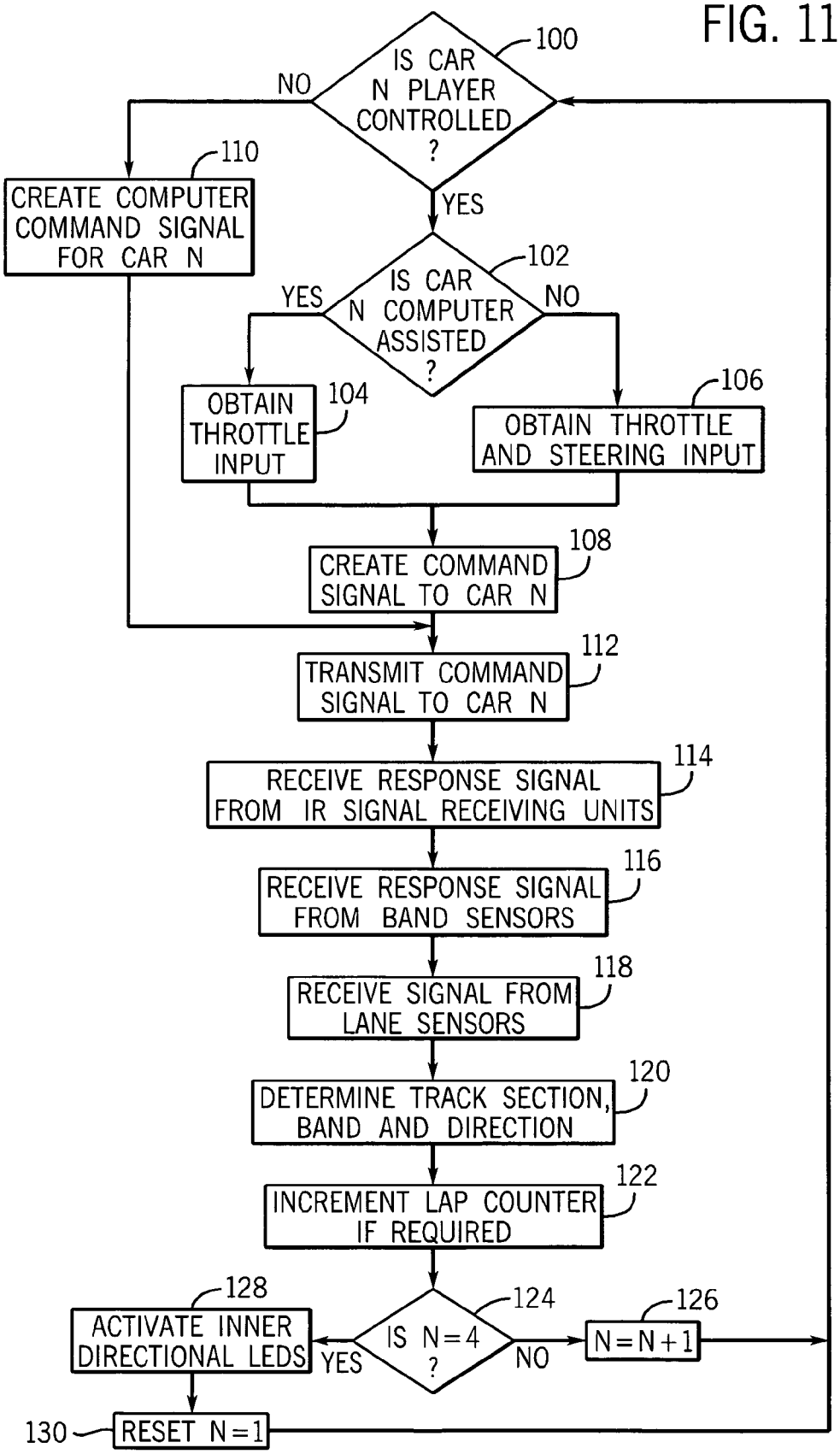
FIG. 11 is an operational flow diagram for the computer controller.

Referring now to FIG. 11, thereshown is a schematic flow diagram of the operational steps performed by the computer control system (CCS) to carry out the operation of a race for the car racing game of the present invention. As described previously, the car racing game includes multiple control stations that allow multiple players to control the operation of a race car associated with each of the control stations 34. In the embodiment of the invention illustrated, the car racing game includes four control stations 34 that control the operation of four separate race cars, each of which is assigned to one of the control stations 34. The CCS of the car racing game allows a race to be carried out regardless of the number of paying players at the control stations 34. As an example, if only two players occupy the control stations 34, the CCS of the car racing game allows these two players to control the operation of two of the race cars, while the CCS controls the operation of the remaining two race cars.

Referring now to FIG. 11, the computer controller initially determines in step 100 whether the first race car N is player controlled. The determination of whether car N is player controlled depends upon whether a player has inserted money or tokens into one of the control stations 34.

If the computer controller determines that the car is player controlled, the computer controller next inquires at step 102 whether car N is computer assisted. As discussed previously, each player has the ability to select between at least a Beginner level and an Expert level depending upon the skill level of the player. If the computer controller determines that the car is computer assisted, the computer controller obtains throttle and steering input from the control station, as shown in step 104. If the car is not computer assisted, the computer controller obtains both throttle and steering input, as illustrated in step 106.

If the car is not computer assisted, the player has the ability to control both the throttle and steering input. However, if the car is computer assisted, the player has complete control over the throttle and the computer modifies the steering input to assist in steering of the car around the race track.

After the computer controller has obtained the desired throttle and steering inputs, the computer controller creates a command signal 108 that will be used to control race car N. As discussed previously, the command signal includes a unique address for the car N as well as throttle and steering information such that the car can update these values during operation.

If, at step 100, the computer controller determines that the car N is computer controlled, the computer controller creates a computer command signal at 110. The computer command signal created at step 110 is based upon the known track position for the car N determined by the last response signal received from car N. Based upon the response signal received from the car, the computer controller can determine the track section, band and direction of the car on the track. Based upon this information, the computer controller can generate a command signal to aid in moving the car further around the race track.

After the command signal has been created, the command signal is transmitted as an IR signal from each of the twelve control signal sending units 48, as illustrated in step 112. Since the control signal sending units 48 are spaced around the entire length of the race track, the car N will receive the command signal no matter its location along the race track.

After the race car identifies its unique address in the command signal, the race car's throttle and steering controls are updated to adjust the movement of the race car. Upon receiving the response signal, the race car immediately transmits a response signal back to the computer controller. As previously described, the response signal from each race car includes information as to which of the directional sensors 84, 86, 88 and 90 sensed the reference beams 82 generated by the inner directional LEDs 80 positioned along the inner guard rail 44 of the race track.

Since only the race car N generates the response signal after receiving the command signal from the computer controller, the computer controller knows which race car has sent the received response signal. Thus, the response signal from the race car does not need address information to be understood by the computer controller.

As illustrated in step 114, the response signal is received by one or more of the IR signal receiving units 58 spaced along the length of a race track and positioned above the position template 54. Based upon which IR signal receiving unit 58 receives the response signal, the computer controller can determine in which track section (1-24) the race car is located when the response signal is generated.

In step 116, the computer controller also receives the response signal from one of the band sensors 62, 64, 66 positioned above the band template. Depending upon which of the band sensors receives the response signal, the computer controller can determine which radial band the race car is located in when the response signal was generated.

Finally, in step 118, the computer controller receives a signal from one or more of the lane sensors 74 positioned along the outer guard rail of the race track. Once again, since only the race can N is generating the car directional beam 70, the signals received from the lane sensor 70 are in direct response to the position of the race car N.

Based upon the information received, the computer controller can determine the track section, band and direction of movement of the race ca N, as illustrated in step 120. The accurate position of the race car on the race track allows the computer controller to determine the position of the race car relative to the other race cars, as well as to the Start/Finish line. If the computer controller determines that the race car has passed over the Start/Finish line since the last position determination, the computer controller increments the lap counter, as illustrated in step 122.

After completing the steps described above, the computer controller determines whether N is equal to four in step 124. In the embodiments of the invention being described, the car racing game includes four individual cars. However, if additional or fewer cars are included in the racing game, N can be compared to the number of cars in the racing game.

If N is not equal to four, the computer controller increments N by one in step 126 and the process begins again for the next race car. Thus, as can be understood by the flow diagram in FIG. 3, the computer controller generates a command signal and determines a race car position for each car sequentially. As described previously, each race car transmits a response signal and receives a command signal approximately twenty times per second. Thus, a player cannot notice the delay in the user inputs being received at and controlling the operation of the race cars.

If in step 124 the computer controller determines that N is equal to four and that all of the race cars have received their command signals, the computer controller activates the directional LEDs 82 positioned along the inner guard rail 44, as illustrated in step 128. As described previously, the inner directional LEDs are activated only upon the completion of the computer control cycling through each of the four race cars. The inner directional LEDs each generate a reference beam 82 that is received by the directional sensors in each race car. Depending upon which directional sensors receive the reference beams, each computer controller can determine the direction of movement of the race car along the race track.

After activating the inner directional LEDs, the computer controller resets N equal to one in step 130 and begins to cycle through each of the four race cars. This process continues for the entire duration of the game for each of the race cars, whether or not the race cars are computer controlled or player controlled.

Other embodiments of this invention could use other means for determining the position and orientation of the cars, including a vision system, laser scanners, different sensor types and locations, and/or broadcasting of position and direction data from the car to the CCS.

What is claimed is:

1. A car racing game for use by a number of players to simulate a race, the game comprising:

a plurality of self-propelled race cars each selectively controllable by one of the players;

a plurality of control stations each associated with one of the race cars, each station including a steering wheel and a throttle for allowing one of the players to actively control the movement of one of the plurality of race cars during the race;

a continuous race track;

a computer controller coupled to each of the control stations and operable to relay player control commands to each of the race cars being actively controlled by the players during the race, the player control commands being based on the position of the steering wheel and the throttle as controlled by one of the players at one of the control stations such that the players can actively control the race car associated with the control station;

a directional beam emitter contained within each race car and positioned to generate a car directional beam extending along the direction of movement of the race car; and a plurality of lane sensors positioned along an outer boundary of the race track and coupled to the computer controller, where each of the lane sensors is operable to receive the directional beam from the race cars such that the computer controller can determine the position of the race car based upon which of the plurality of lane sensors detect the directional beam, wherein the computer controller is operable to automatically generate computer control commands to control the movement of the race cars not being actively controlled by one of the players to direct the race cars not being actively controlled by one of the players along the race track such that all of the plurality of race cars are active during each race.

2. The car racing game of claim 1 further comprising:

a plurality of control signal sending units positioned above and spaced along the race track, each sending unit being operable to generate both the computer and player control commands to the race cars; and a plurality of signal receiving units positioned above and spaced along the race track, each signal receiving unit being operable to receive a response signal from the race cars.

3. The car racing game of claim 2 wherein each of the race cars includes a control signal receiving device and a response signal generating device, wherein the control signal receiving device is operable to receive the computer and player control commands from the computer controller and the control signal generating device is operable to transmit the response signal from the race car.

4. The car racing game of claim 2 wherein the plurality of control signal sending units are each operable to generate a signal pattern onto the race track, wherein the plurality of control signal sending units are spaced such that the signal pattern of one sending unit overlaps the signal pattern of the sending units positioned on each side of the one sending unit.

5. The car racing game of claim 2 wherein each of the control signal sending units simultaneously generates the same control command, the control command having an address included in an address field such that only the race car assigned the address responds to the control command.

6. The car racing game of claim 5 wherein the computer controller is operable to sequentially generate the control commands to each of the race cars.

7. The car racing game of claim 2 further comprising:

a first band sensor positioned above the race track, the first band sensor being operable to receive the response signal from the race cars when the race cars are in a first detection range extending from the inner boundary of the race track; and a second band sensor positioned above the race track, the second band sensor being operable to receive the response signal from the race cars, the second band sensor having a second detection range extending from the inner boundary of the race track, wherein the second detection range is greater than the first detection range, wherein both the first band sensor and the second band sensor are coupled to the computer controller such that the computer controller can determine the position of the race car from the inner boundary based upon which of the first and second band sensors detect the response signals.

8. The car racing game of claim 7 further comprising a band template positioned between the first and second band sensors and a race track, wherein the band template includes a first opening aligned with the first band sensor and a second opening aligned with a second band sensor, wherein the size of the first and second openings define the detection range for each of the first and second band sensors.

9. The car racing game of claim 1 wherein each control station includes a difficulty selector operable between at least a first position and a second position, wherein when the difficulty selector is in the first position, the computer controller assists in the player controlled operation of the race car associated with the control station and when the difficulty switch is in the second position, the computer controller does not assist in the player controlled operation of the race car associated with the control station.

10. The car racing game of claim 1 further comprising:

a plurality of inner directional LEDs spaced along an inner boundary of the race track, each inner directional LED being operable by the computer controller to generate a reference beam; and a front directional sensor, a back directional sensor, a left directional sensor and a right directional sensor positioned on each race car, each directional sensor being operable to selectively receive the reference beams from the inner directional LEDs depending on the orientation of the race car relative to the reference beams, wherein the response signal from each of the race cars reports which of the directional sensors of the race car detect the reference beams such that the computer controller can determine the orientation of the race car.

11. The car racing game of claim 1 wherein the player control commands from the computer controller includes a directional command based upon the position of the steering wheel and a speed command based upon the position of the throttle.

12. A method of operating a car racing game including a plurality of race cars each selectively controllable by a player through a control station, the race cars being movable along a continuous race track, the method comprising the steps of:

providing a computer controller operable to generate either a player control command or a computer control command to each of the race cars to control the operation of the race car;

determining the number of active players for a race, wherein each active player controls the operation of one of the cars through one of the control stations;

determining the number of computer controlled race cars for the race, wherein the computer controlled race cars include all of the race cars that are not player controlled;

upon the beginning of the race, relaying the player control commands to each of the active race cars based upon player input from the control station associated with the race car;

generating a car directional beam along the direction of race car travel as each race car travels along the race track;

positioning a plurality of lane sensors along an outer boundary of the race track, each lane sensor being coupled to the computer controller;

detecting the car directional beam from each race car at least one of the lane sensors;

determining the position of the race car based upon which lane sensor detects the car directional beam; and relaying computer generated computer control commands to the computer controlled race cars based upon the detected position of the race car from the lane sensors to cause the computer controlled race cars to move along the race track such that all of the race cars move along the race track during a race.

13. The method of claim 12 further comprising the steps of:

positioning a plurality of signal receiving units above the race track, each signal receiving unit being coupled to the computer controller and operable to detect a response signal generated by each race car;

determining the position of the race car along the race track based upon which of the signal receiving units receives the response signal from the race car; and creating the computer generated computer control command for each of the computer controlled race cars based upon the position of the computer controlled race car along the race track such that the computer generated computer control commands guide the race car around the race track.

14. The method of claim 13 further comprising the steps of:

positioning a first band sensor above the race track, the first band sensor being operable to receive the response signal from the race cars when the race cars are in a first detection range extending from an inner boundary of the race track;

positioning a second band sensor above the race track, the second band sensor being operable to receive the response signal from the race cars when each race car is within a second detection range extending from the inner boundary of the race track, wherein the second detection range is greater than the first detection range;

selectively receiving the response signal from the first and second band sensors at the computer controller; and determining the position of the race car from the inner boundary of the race track based upon which of the first and second band sensors detects the response signal.

15. The method of claim 12 further comprising the steps of:

allowing each player at each control station to select a driving level from at least a first level and a second level; and assisting the operation of the race car associated with the control station when the player selects the first driving level.

16. The method of claim 15 wherein the step of assisting the operation of the race car includes the step of relaying computer generated control commands to the player controlled race car to control the steering of the player controlled race car while allowing the player to control the speed of the race car.

17. A car racing game for use by a number of players to simulate a race, the game comprising:

a plurality of self-propelled race cars each selectively controllable by one of the players;

a plurality of control stations each associated with one of the race cars, each station including a steering wheel and a throttle for allowing one of the players to actively control the movement of one of the plurality of race cars during the race;

a continuous race track;

a computer controller coupled to each of the control stations and operable to relay player control commands to each of the race cars being actively controlled by the players during the race, the player control commands being based on the position of the steering wheel and the throttle as controlled by one of the players at one of the control stations such that the players can actively control the race car associated with the control station;

a plurality of inner directional LEDs spaced along an inner boundary of the race track, each inner directional LED being operable by the computer controller to generate a reference beam; and a front directional sensor, a back directional sensor, a left directional sensor and a right directional sensor positioned on each race car, each directional sensor being operable to selectively receive the reference beams from the inner directional LEDs depending on the orientation of the race car relative to the reference beams, wherein the response signal from each of the race cars reports which of the directional sensors of the race car detects the reference beam such that the computer controller can determine the orientation of the race car, wherein the computer controller is operable to automatically generate computer control commands to control the movement of the race cars not being actively controlled by one of the players to direct the race cars not being actively controlled by one of the players along the race track such that all of the plurality of race cars are active during each race.

18. The car racing game of claim 17 further comprising:

a plurality of control signal sending units positioned above and spaced along the race track, each sending unit being operable to generate both the computer and player control commands to the race cars; and a plurality of signal receiving units positioned above and spaced along the race track, each signal receiving unit being operable to receive a response signal from the race cars.

19. The car racing game of claim 17 further comprising:

a first band sensor positioned above the race track, the first band sensor being operable to receive the response signal from the race cars when the race cars are in a first detection range extending from the inner boundary of the race track; and a second band sensor positioned above the race track, the second band sensor being operable to receive the response signal from the race cars, the second band sensor having a second detection range extending from the inner boundary of the race track, wherein the second detection range is greater than the first detection range, wherein both the first band sensor and the second band sensor are coupled to the computer controller such that the computer controller can determine the position of the race car from the inner boundary based upon which of the first and second band sensors detect the response signals.

20. A method of operating a car racing game including a plurality of race cars each selectively controllable by a player through a control station, the race cars being movable along a continuous race track, the method comprising the steps of:

providing a computer controller operable to generate either a player control command or a computer control command to each of the race cars to control the operation of the race car;

determining the number of active players for a race, wherein each active player controls the operation of one of the cars through one of the control stations;

determining the number of computer controlled race cars for the race, wherein the computer controlled race cars include all of the race cars that are not player controlled;

upon the beginning of the race, relaying the player control commands to each of the active race cars based upon player input from the control station associated with the race car; and relaying computer generated computer control commands to the computer controlled race cars to cause the computer controlled race cars to move along the race track such that all of the race cars move along the race track during a race;

generating a plurality of reference beams along an inner boundary of the race track;

positioning a plurality of directional sensors on each race car, wherein each directional sensor is operable to detect the reference beams generated along the inner boundary of the race path; and including the number of directional sensors that detect the reference beams in the response signal from the race car such that the computer controller can determine the direction of operation of the race car on the race track.

* * * * *